US011174708B2

(12) United States Patent
Renshaw et al.

(10) Patent No.: US 11,174,708 B2
(45) Date of Patent: Nov. 16, 2021

(54) POWER DOWNHOLE TOOL VIA A POWERED DRILL STRING

(71) Applicant: Halliburton Energy Services, Inc., Houston, TX (US)

(72) Inventors: William Shaun Renshaw, Calgary (CA); Ryan David Zallas, Sherwood Park (CA)

(73) Assignee: Halliburton Energy Services, Inc., Houston, TX (US)

( * ) Notice: Subject to any disclaimer, the term of this patent is extended or adjusted under 35 U.S.C. 154(b) by 28 days.

(21) Appl. No.: 16/717,562

(22) Filed: Dec. 17, 2019

(65) Prior Publication Data

US 2020/0277840 A1 Sep. 3, 2020

Related U.S. Application Data

(63) Continuation-in-part of application No. PCT/US2019/020037, filed on Feb. 28, 2019.

(51) Int. Cl.

| | |
|---|---|
| ***E21B 41/00*** | (2006.01) |
| ***E21B 17/00*** | (2006.01) |
| ***E21B 49/00*** | (2006.01) |
| ***E21B 47/0228*** | (2012.01) |

(Continued)

(52) U.S. Cl.

CPC ..... *E21B 41/0085* (2013.01); *E21B 17/003* (2013.01); *E21B 47/0228* (2020.05); *E21B 49/00* (2013.01); *E21B 17/1078* (2013.01); *E21B 34/066* (2013.01)

(58) Field of Classification Search

CPC ..... E21B 41/0085; E21B 47/0228; E21B 17/003; E21B 49/00; E21B 17/1078; E21B 34/066

See application file for complete search history.

(56) References Cited

U.S. PATENT DOCUMENTS 4,416,494 A * 11/1983 Watkins ..... E21B 17/003 175/45

2006/0028321 A1 2/2006 Kennedy et al.

(Continued)

FOREIGN PATENT DOCUMENTS

WO 2012027105 A1 3/2012

WO 2017087483 A1 5/2017

*Primary Examiner* — Brad Harcourt

(74) *Attorney, Agent, or Firm* — Benjamin Ford; Parker Justiss, P.C.

(57) ABSTRACT

The disclosure is directed to a method and system to provide electrical current to a downhole tool, such as an active magnetic ranging tool. The electrical current can be transmitted through a drill string, with an end attached drilling assembly inserted into a wellbore. The downhole tool can include a power isolation sub to create an isolated electrical zone along the drill string. The downhole tool can transmit an electrical current along a designated portion of a subterranean formation to create a resultant magnetic field to be detected by the active magnetic ranging tool or other downhole tools. A drilling wellbore can maintain drilling operations while actively ranging a target well for intercept and other operations. The drilling assembly does not need to be removed from the wellbore to enable the activities of the active magnetic ranging tool, and access to the target wellbore is not needed.

20 Claims, 11 Drawing Sheets

(51) Int. Cl.
*E21B 17/10* (2006.01)
*E21B 34/06* (2006.01)

(56) References Cited

U.S. PATENT DOCUMENTS

| | | | | |
|---|---|---|---|---|
| 2010/0044108 | A1* | 2/2010 | Bespalov | E21B 47/022 175/24 |
| 2012/0268074 | A1* | 10/2012 | Cooley | H02J 7/0042 320/130 |
| 2013/0173164 | A1 | 7/2013 | Zhang | |
| 2015/0219783 | A1 | 8/2015 | Sitka | |
| 2016/0047224 | A1* | 2/2016 | Wilson | E21B 47/092 175/45 |
| 2016/0273337 | A1* | 9/2016 | Donderici | E21B 47/024 |

* cited by examiner

POWER DOWNHOLE TOOL VIA A POWERED DRILL STRING

CROSS-REFERENCE TO RELATED APPLICATION

This application is a continuation-in-part of PCT International Application No. PCT/US2019/020037, entitled "POWER BOTTOM HOLE ASSEMBLY VIA A POWERED DRILL STRING", filed on Feb. 28, 2019. The above-listed application is commonly assigned with the present application and incorporated herein by reference as if reproduced herein in its entirety.

TECHNICAL FIELD

This application is directed, in general, to powering wellbore downhole tools and, more specifically, to utilizing a drill string as part of the electrical circuit to provide electrical current to the downhole tools.

BACKGROUND

In operating and managing a well system, the well system operation team may need to provide electrical current to downhole tools to perform various operations, such as to gain more information regarding the subterranean formation near a location within the wellbore or to measure a distance to a neighboring well, such as for a well intercept. For example, subterranean formation information or distance measurement may be acquired using a generated magnetic field that is then detected and measured. Currently, the active magnetic ranging system that is used to generate the magnetic field is lowered into a wellbore after the drilling bottom hole assembly has been raised. Raising the drilling bottom hole assembly then lowering the active magnetic ranging system can be expensive in terms of time taken to raise and lower the various pieces of equipment. Many current downhole tools, such as the active magnetic ranging system, utilize wireline techniques for supporting and providing electrical current to the systems. Being able to support and provide electrical current to downhole tools without having to remove the drilling bottom hole assembly would be beneficial.

SUMMARY

In one aspect, a method for transmitting electrical energy to a downhole tool is disclosed. In one embodiment, the method includes: (1) transmitting a first electrical current utilizing a drill string, wherein the drill string is located within a drilling wellbore of a well system, (2) regulating a second electrical current utilizing the first electrical current, wherein the regulating provides amperes that exceeds the amperes generated from the first electrical current, and (3) utilizing the second electrical current with the downhole tool.

In a second aspect, a system to transmit electrical energy in a wellbore of a well system is disclosed. In one embodiment, the system includes: (1) a downhole tool, operable to receive energy and perform an action within the wellbore, (2) a drill string, located in the wellbore and electrically coupled to a first energy source located at a surface position, operable to complete an electrical circuit, and (3) an energy regulator, located proximate the downhole tool and electrically coupled to the drill string, operable to regulate energy received and provide electrical current to the downhole tool.

BRIEF DESCRIPTION

Reference is now made to the following descriptions taken in conjunction with the accompanying drawings, in which.

DETAILED DESCRIPTION

Figure 1A:
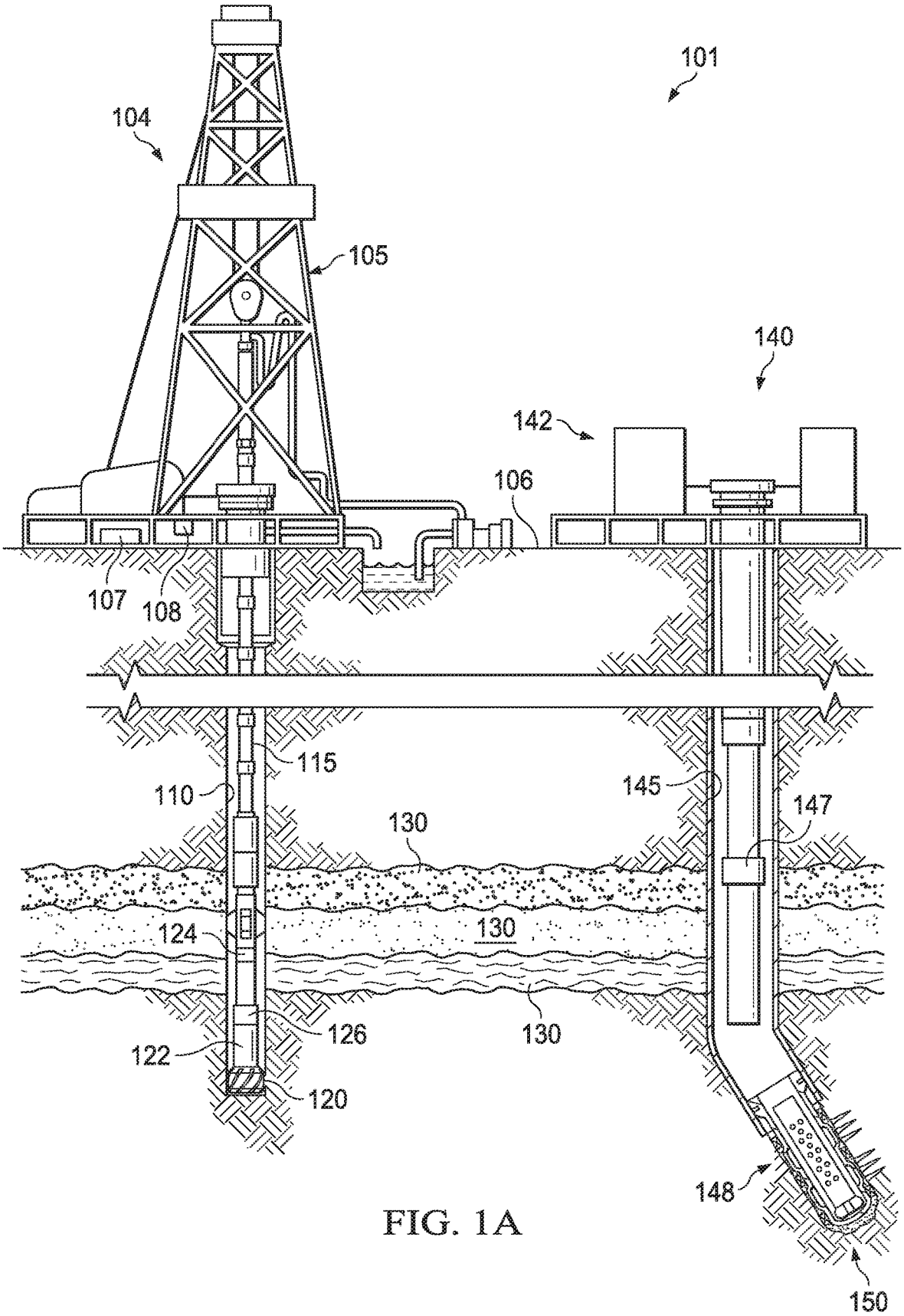
FIG. 1A is an illustration of diagram of an example logging while drilling (LWD) well system with a drill string transmitting electrical current.

In the hydrocarbon production industry, e.g., oil and gas production, it can be beneficial to determine more information about the surrounding subterranean formation along a portion of a wellbore or to determine a relative positioning of a neighboring, i.e., target wellbore. In addition, other measurements may be taken, along with the operation plan to move, orient, and position downhole tools. One technique to perform subterranean formation measurements can be to utilize an active magnetic ranging system, which is an example system used for demonstrating various principles within this disclosure. When measuring a relative position to a target wellbore, an electrical current released by the active magnetic ranging system can build on the target wellbore and induce a magnetic field.

Typically, the active magnetic ranging system can be implemented utilizing a downhole tool, such as an active magnetic ranging tool that is part of an active magnetic ranging bottom hole assembly (BHA). In order to lower the active magnetic ranging tool into a wellbore, the drilling BHA is removed from the wellbore allowing a wireline connecting to the active magnetic ranging BHA to be lowered into the wellbore. The time taken to remove the drilling BHA, insert the active magnetic ranging BHA, remove the active magnetic ranging BHA, and reinsert the drilling BHA, i.e., tripping the various BHA, can be extensive and result in additional costs associated with operating the wellbore. The tripping cost can be exacerbated by very deep wellbores, such as those typically found in offshore wells, or for high profile relief wells. For example, for a deep offshore well the trip time can be in excess of 24 hours and, depending on the offshore rig being utilized, can result in approximately 1.0 to 3.0 million dollars of rig time.

An alternative industry solution is to insert one or more components, such as the active magnetic ranging BHA into the target wellbore while continuing to utilize the drilling BHA in the drilling wellbore. This can provide the relative data, i.e., ranging data, used by the drilling wellbore operators while requiring access to the target wellbore. In situations where access is not possible, for example, a target wellbore blowout or where the target wellbore is otherwise inaccessible, the current solutions are not possible. For the target wellbore blowout scenario, reducing the drilling time to an intercept point of the target wellbore can be advantageous in limiting the danger, production loss, adverse environmental effects, and wellbore operation cost.

Issues can occur regarding providing adequate electrical current to the active magnetic ranging BHA when attempting to attach an active magnetic ranging BHA to a drilling BHA or to attach the active magnetic ranging BHA proximate to the drilling BHA. The electrical current requirements of the active magnetic ranging BHA can exceed that which can be provided using conventional techniques, such as batteries. The ability to increase the electrical current, i.e., increasing the amperage, provided to the active magnetic ranging BHA and other downhole tools can be beneficial. The increase in electrical current can lead to a larger electrical current being transmitted to the subterranean formation thereby allowing adjustments to the volume of interest being measured. The adjustments to the volume of interest can result in greater distances, e.g., depth, which can be measured, a change in the angle between the release of the electrical current and the target to be measured, a change in the resolution, e.g., details, that can be measured, and higher quality measurements through high resistance subterranean formations.

This disclosure presents a method and system that can provide sufficient power to a downhole tool when the downhole tool is located proximate to the drilling BHA. These types of BHA can be utilized in logging while drilling (LWD) or measure while drilling (MWD) well operations. This can allow for downhole tool usage, such as active magnetic ranging, while the drilling BHA remains in the wellbore. The drilling activity can be temporarily suspended or remain in progress during the downhole tool usage.

Significant time and cost savings can be realized through the elimination of tripping the drilling BHA. Electrical current can be transmitted via the drill string attached to the drilling BHA. The electrical current, when subterranean formation measurements are being conducted, can then be transmitted to the subterranean formation at an indicated position and direction to generate a magnetic field. Appropriate electrical insulation and isolation components can be added to the drilling BHA and the downhole tools to ensure proper electrical isolation and control.

The resultant magnetic field generated by the target wellbore or subterranean formation can be measured utilizing conventional ranging equipment, for example a surface-access magnetic ranging service when direct electrical current is being utilized. In addition, a magnetic gradient field sensor located at the distill end of the drill string in or above the drill bit can be included with the drilling BHA for the benefit of target wellbore interception activity, such as when alternating electrical current is utilized.

The drill string can be modified to be able to safely transmit the electrical current downhole. Normally, about 6 amperes (amps) of electrical current or more is utilized by the active magnetic ranging BHA where the electrical current is transmitted through a wireline. Modifying the drill string to be able to transmit larger amperage would be beneficial. Typical active magnetic ranging effective range is approximately 150 feet, though the distance can vary with the type of subterranean formation between the active magnetic ranging and the target location, such as the proximity of high resistance subterranean formations. Increasing the amperage supplied to the active magnetic ranging can increase the distance since there can be a greater amount of electrical current transmitted to the subterranean formation. Increasing the amperage supplied to the active magnetic ranging BHA can also increase the distance at various angles as compared to the horizontal line extending from the active magnetic ranging BHA. For example, a ranging distance achievable at a 0° (degree) angle to the horizontal line can be greater than the ranging distance at an angle of −25° from the horizontal line. Increasing the amperage to the active magnetic ranging BHA can extend the distance at the −25° angle.

At a designated point above the drilling BHA, a traditional isolation sub can be located on the drill string. The traditional isolation sub can electrically isolate the drill string at that point. Above the traditional isolation sub can be a power isolation sub. The distance between the traditional isolation sub and the power isolation sub can be of various distances per the drilling operation plan. In some implementations, the distances can be, 50.0 feet to 200 feet. The power isolation sub, which can be fixed or moveable, can be positioned along a point in the wellbore. The power isolation sub can transmit electrical current into the subterranean formation. The transmitted electrical power creates an electrical current that can pass through the subterranean formation and electrical current can build on a target wellbore thereby generating a magnetic field. In an alternative aspect, a magnetically reactive portion of the subterranean formation can generate a magnetic field from the transmitted electrical current.

Alternately, the drill string can be utilized as a distributed electrode. A drill string electrode device would be located on the drill string and the traditional isolation sub would be removed. The electrode device can be fixed or moveable, and positioned appropriately within the wellbore. The electrical current can be transmitted to the appropriate depth in the wellbore and transmitted to the exterior of the drill string utilizing the electrode device. The electrical current can then find the weakest path to the target wellbore or the magnetically reactive subterranean formation.

The detected magnetic field data can be processed by the active magnetic ranging BHA, another tool, or transmitted via the drill string to surface well equipment for further processing and analysis. The transmission through the drill string can utilize a conventional technique. Whether the surface well equipment processes the collected magnetic field data or processes the resulting processing from a downhole tool, the surface well equipment can analyze the data and further direct the well system operations. For example, the well system operations can adjust drilling operations to better intercept the target wellbore or subterranean formation, or avoid the target wellbore or subterranean formation.

A local electrical energy source can be located proximate to the downhole tools. The local electrical energy source can provide a burst of electrical current at a higher amperage than provided by the electrical current transmitted through the drill string, e.g., increase the watts used over a time interval by draining the joules of energy stored which can be used independently of the surface energy source or in combination with the surface energy source to boost the energy available. This can allow the downhole tool, such as the active magnetic ranging BHA, to take advantage of the additional electrical current to increase the range, resolution, and angle of measurement, e.g., adjust the volume of interest that is measured. The electrical current transmitted through the drill string can be utilized to recharge the local electrical energy source. The local electrical energy source can be one or more batteries, capacitors, and other energy storage devices.

A drill string can transmit either alternating current (AC) or direct current (DC). Depending on the type of electrical current utilized by the downhole tool or the local electrical energy source, an energy converter can be located proximate to the downhole tool or local electrical energy source. The energy conversion component can convert AC to DC or DC to AC as appropriate for the electrical current supplied and for the type of electrical current used by the downhole tool. DC current is typically transmitted when the drill string utilizes inductive coupling. AC current is typically transmitted when the drill string utilizes direct coupling. The use of AC current also provides the benefit of the ability to vary the electrical energy frequency. This provides similar benefit as compared to a wireline supported downhole tool.

Turning now to the figures, FIG. 1A is an illustration of diagram of an example LWD well system 101 with a drill string transmitting electrical current. LWD well system 101 includes two wellbore systems 104 and 140. Wellbore system 104 is a LWD system and includes derrick 105 supporting drill string 115, surface electrical energy source 107, and surface well equipment 108. Derrick 105 is located at surface 106. Extending below derrick 105 is wellbore 110 in which drill string 115 is inserted. Located at the bottom of drill string 115 is a drilling BHA 120, a BHA tool 122, an active magnetic ranging detection component 126, and a power isolation sub 124. BHA tool 122, active magnetic ranging detection component 126, and power isolation sub 124 can be considered the active magnetic ranging BHA for this example.

Wellbore system 140 is a completed well system and includes surface well equipment 142, a wellbore 145, cased sections 147, uncased section 148, and an end of wellbore assembly 150. Between wellbore system 104 and wellbore system 140 is a subterranean formation 130. Subterranean formation 130 can be one or more types of mineralogical and geological formations as naturally found in nature.

Surface electrical energy source 107 can supply electrical current to drill string 115. The electrical energy can be AC or DC depending on the transmission capability of drill string 115. If the BHA uses one type of electrical energy and the electrical energy transmitted using drill string 115 is of the other type, then an energy converter can be included with the BHA to convert from one type of electrical energy to the other. Surface well equipment 108 can transmit data and instructions utilizing drill string 115 to the various BHA, such as BHA tool 122, active magnetic ranging detection component 126, and power isolation sub 124. Surface well equipment 108 can receive data transmitted using drill string 115 from these tools and components.

In this example, power isolation sub 124 can create an electrical transmission along the wellbore wall proximate to subterranean formation 130. The electrical current can collect at wellbore 145 and create a magnetic field that is detectable by active magnetic ranging detection component 126. Active magnetic ranging detection component 126 can then transmit the detected data to surface well equipment 108.

If an optional local electrical energy source is located proximate the power isolation sub then surface electrical energy source 107 can provide electrical current to recharge the local electrical energy source. Local electrical energy source can be used to supply electrical power to power isolation sub 124, active magnetic ranging detection component 126, and other BHA tools. An energy regulator can also be included as an optional component, located proximate to the local electrical energy source. The energy regulator can control the amount of electrical current that is sent to the other components and downhole tools. This can allow a downhole tool to utilize a higher amperage than is provided by surface electrical energy source 107.

Figure 1B:
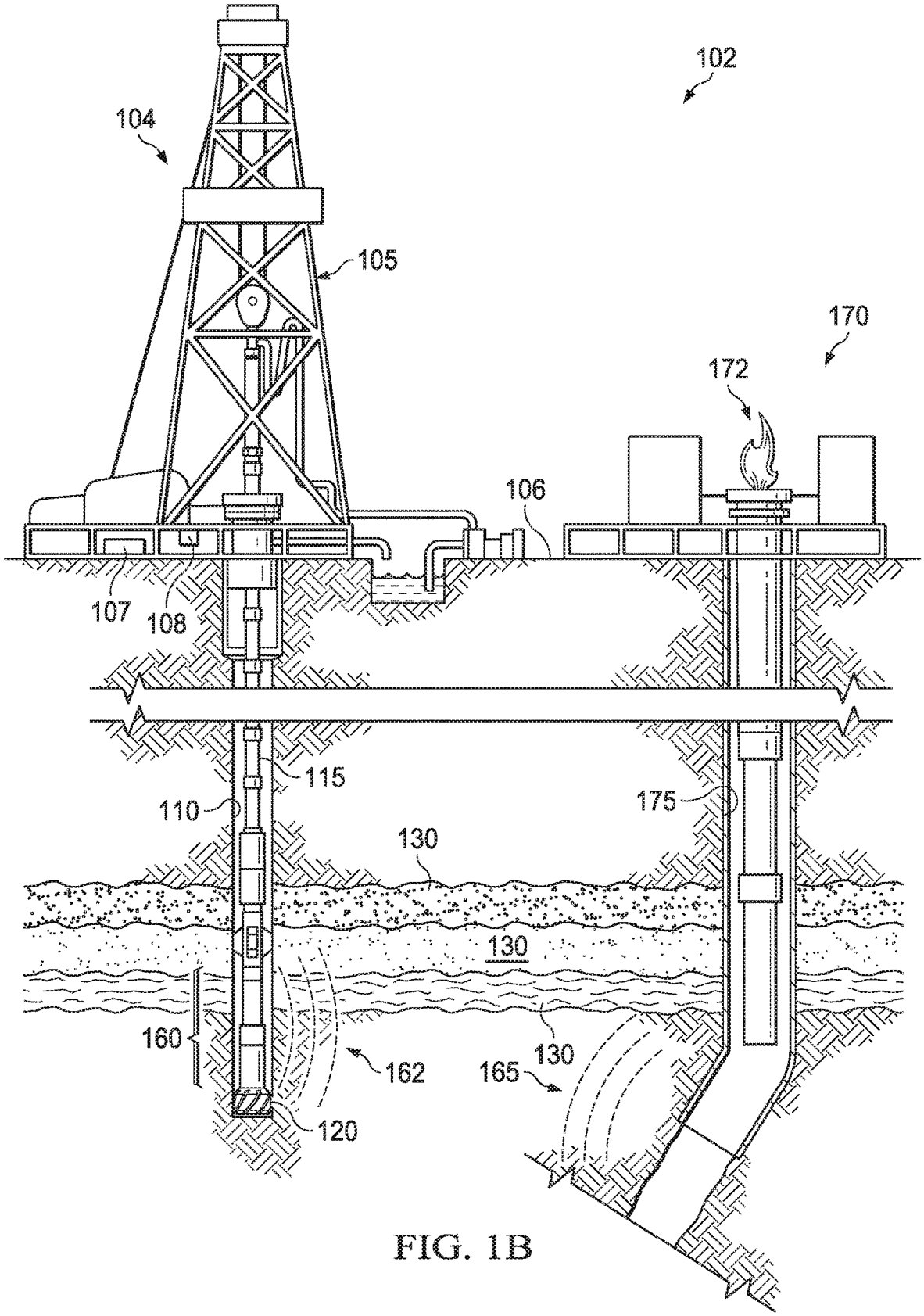
FIG. 1B is an illustration of a diagram of an example intercept well drilling utilizing a drill string to energize downhole tools.

FIG. 1B is an illustration of a diagram of an example intercept well drilling 102 utilizing a drill string to energize downhole tools. Intercept well drilling 102 is similar to FIG. 1A. In FIG. 1B, wellbore system 140 has been replaced by a wellbore system 170. Wellbore system 170 includes wellbore 175 and is in a blowout scenario as indicated by blowout 172. BHA tool 122, active magnetic ranging detection component 126, and power isolation sub 124 have been identified collectively as active magnetic ranging BHA 160.

Active magnetic ranging BHA 160, powered using drill string 115, can transmit the electrical current to subterranean formation 130 as shown by electrical current 162. Electrical current 162 can collect and build at wellbore 145 creating magnetic field 165. Magnetic field 165 can be detected by active magnetic ranging BHA 160. Relative positioning data can be deduced from detected magnetic field 165 and updates to the well operation plan can be made to more efficiently execute the intercept operation. Since wellbore system 170 is in a blow state, access to wellbore 175 is not possible. In addition, a wellbore interception can be completed quickly to minimize danger, the loss of hydrocarbon production, and well system cost.

Although FIGS. 1A and 1B depict specific borehole configurations, those skilled in the art will understand that the disclosure is equally well suited for use in wellbores having other orientations including vertical wellbores, horizontal wellbores, slanted wellbores, multilateral wellbores, and other wellbore types. FIGS. 1A and 1B depict an onshore operation. Those skilled in the art will understand that the disclosure is equally well suited for use in offshore operations.

Figure 2A:
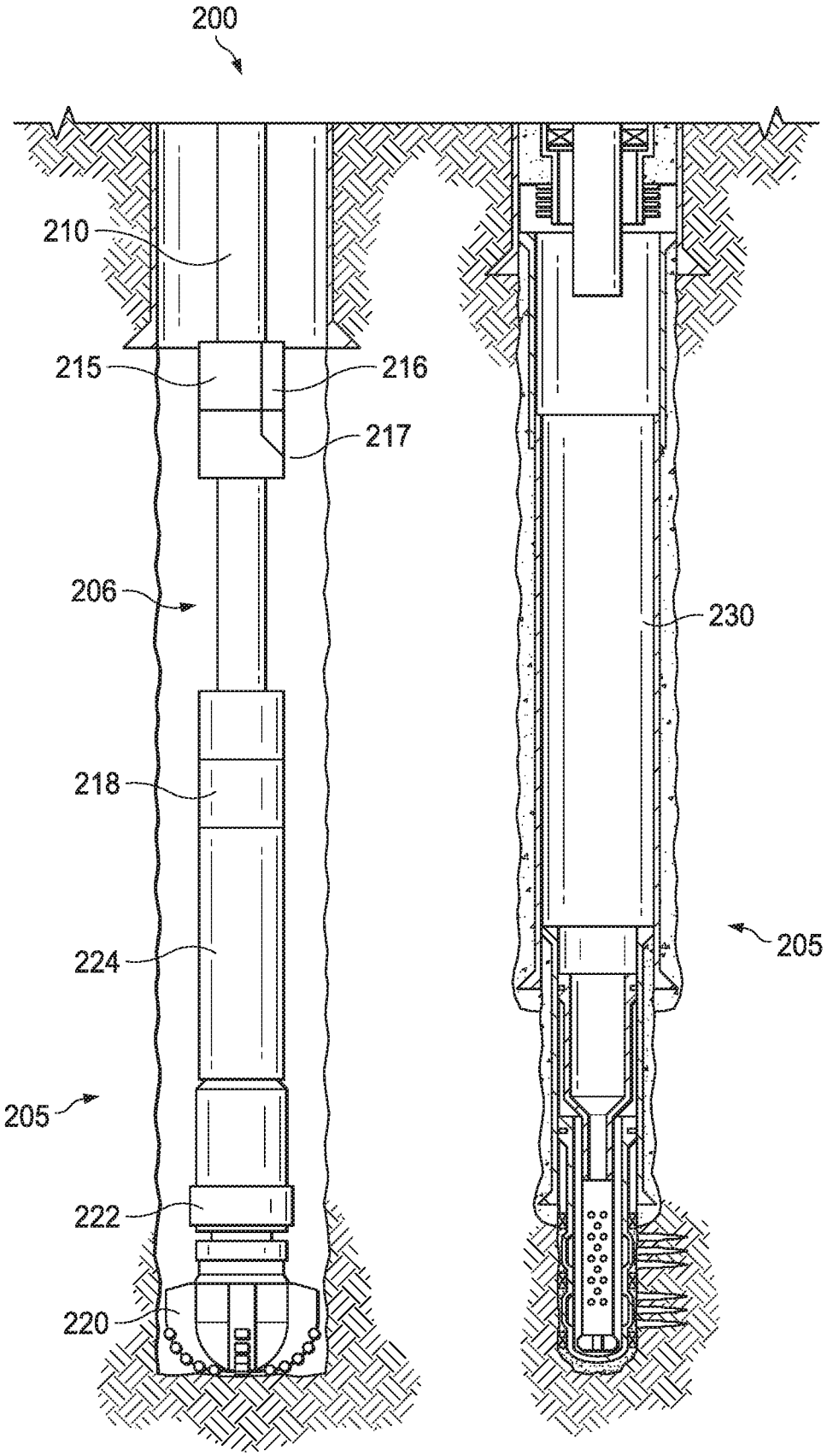
FIG. 2A is an illustration of a diagram of an example drill string system capable of transmitting electrical current to a downhole tool.

FIG. 2A is an illustration of a diagram of an example drill string system 200 capable of transmitting electrical current to a downhole tool. In this example, drill string system 200 includes two wellbores, an active drilling wellbore 206 and a target wellbore 230. Active drilling wellbore 206 and target wellbore 230 are located in subterranean formation 205. Subterranean formation 205 and be heterogeneous or homogeneous formation types. Active drilling wellbore 206 can be wellbore system 104 and target wellbore 230 can be one of wellbore systems 140 and 170.

Active drilling wellbore 206 includes drill string 210 capable of transmitting electrical current from a surface energy source to downhole tools and BHA tools. Attached to drill string 210 is a power isolation sub 215. A controllable electrical transmission device 216 is part of power isolation sub 215. The position and angle of electrical transmission device 216 can be adjusted. The adjusting can allow electrical transmission device 216 to generate an electrical current into subterranean formation 205 in a determined direction and angle. The electrical current can be released at an outside location of the drill string at exterior location 217. The electrical current can flow through subterranean formation 205 and either generate a magnetic field when the electrical current interacts with a magnetically reactive portion of subterranean formation 205 or generate a magnetic field when the electrical current builds on target wellbore 230.

Power isolation sub 215 can electrically isolate the lower portion of drill string 210 and can pass through to the lower attached BHA, a portion of the electrical current transmitted through drill string 210. In some aspects, power isolation sub 215 can be moved along drill string 210 to position electrical transmission device 216 at a specified location. If the optional power converter, power regulator, and local electrical energy source are present, they can be included proximate to power isolation sub 215 and be electrically coupled to one another as well as to other tools and devices.

Traditional isolation sub 218 can be located lower on drill string 210 compared to power isolation sub 215. The distance between power isolation sub 215 and traditional isolation sub 218 can vary, with 50.0 feet to 200.0 feet being typical. Traditional isolation sub 218 can provide electrical isolation for the lower attached components.

Various tools 224 can be located below traditional isolation sub 218, such as measuring and detecting tools. Also located in this area can be a magnetic gradient field sensor 222 which can be used to assist in detecting the magnetic fields generated from the electrical transmissions. Magnetic gradient field sensor 222 can short hop the collected data to another sub which in turn transmits the data uphole to other well system equipment. Collectively, power isolation sub 215, electrical transmission device 216, traditional isolation sub 218, and various tools 224 can be considered the active magnetic ranging BHA. At the end of drill string 210 is a drilling tool 220.

Drill string system 200 is demonstrating that in an active drilling wellbore, active magnetic ranging can take place targeting a target well. Access to the target well is optional to complete the active magnetic ranging measurements. Power to the active magnetic ranging BHA can be provided using drill string 210.

The active magnetic ranging BHA includes several described components. These components are a functional description of the functions provided by these components. The components can be combined in various combinations in practice. For example, various tools 224 can be combined with power isolation sub 215, and electrical transmission device 216 can be a separate device from power isolation sub 215. Another example is that various tools 224 can be a separate bottom hole tool from the active magnetic ranging BHA. In addition, the power isolation sub can be replaced by a distributed electrode device attached to the drill string where that device can initiate the electrical transmission into the subterranean formation at a designated location.

Figure 2B:
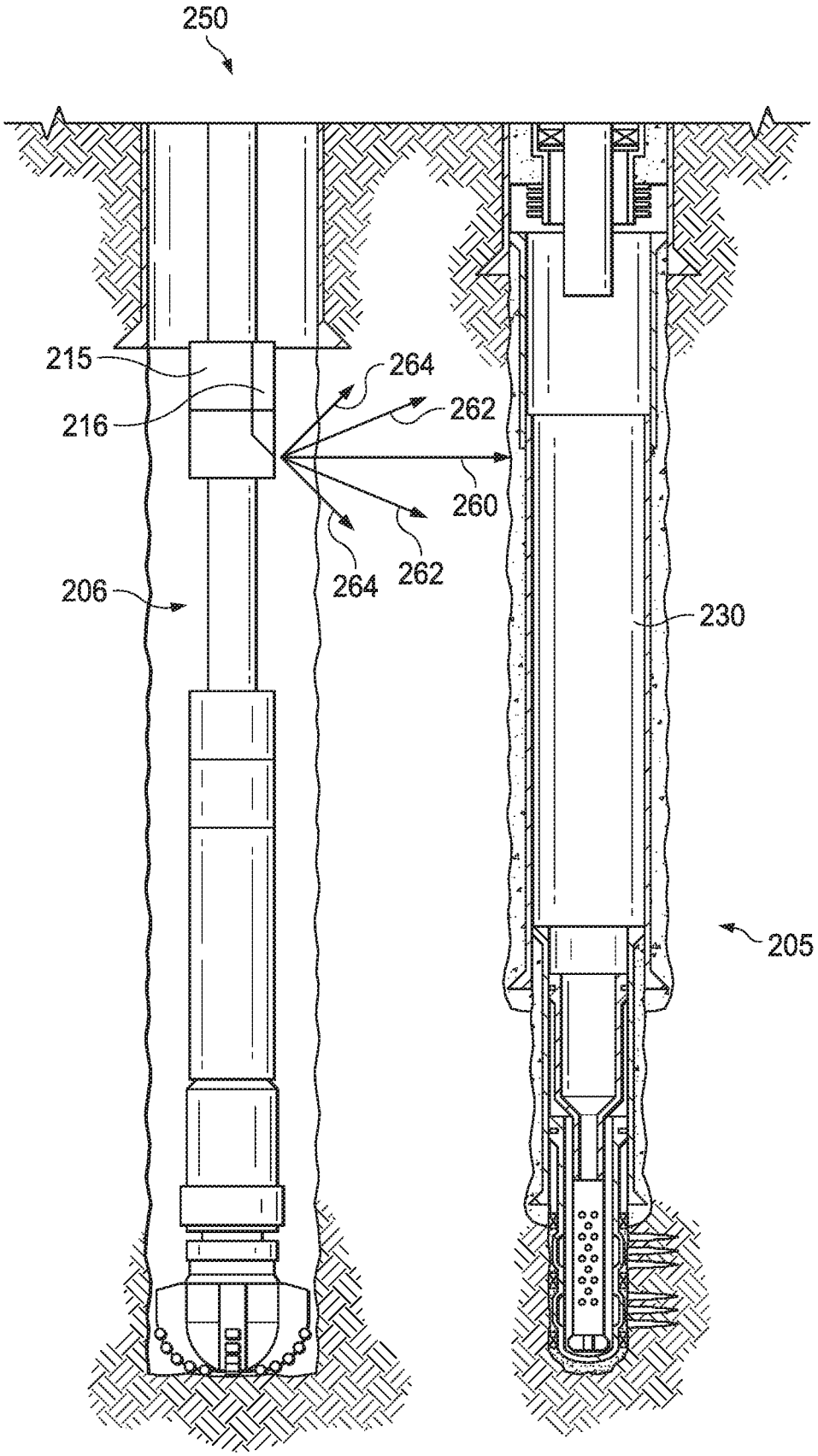
FIG. 2B is an illustration of a diagram of an example distance and angle measurement utilizing an active magnetic ranging bottom hole assembly (BHA)

FIG. 2B is an illustration of a diagram of an example distance and angle measurement 250 utilizing an active magnetic ranging BHA. Distance and angle measurement 250 is demonstrating that as the angle changes relative to the angle of electrical transmission device 216, the distance at which a magnetic field can be detected by the active magnetic ranging BHA changes. Distance and angle measurement 250 utilizes the same diagram and description as provided in FIG. 2A. Arrow 260 demonstrates that the distance a magnetic field can be detected is a maximum value, for example, 150 feet, when oriented at a 0° angle relative to electrical transmission device 216. As the angle changes, such as shown by arrows 262 in the positive and negative relative directions, the length of arrows 262 is transmitted indicating the distance for detection also decreases. Arrows 264 represent much larger angle deviations from electrical transmission device 216 and therefore the detectable distance in these directions are significantly shorter.

Figure 2C:
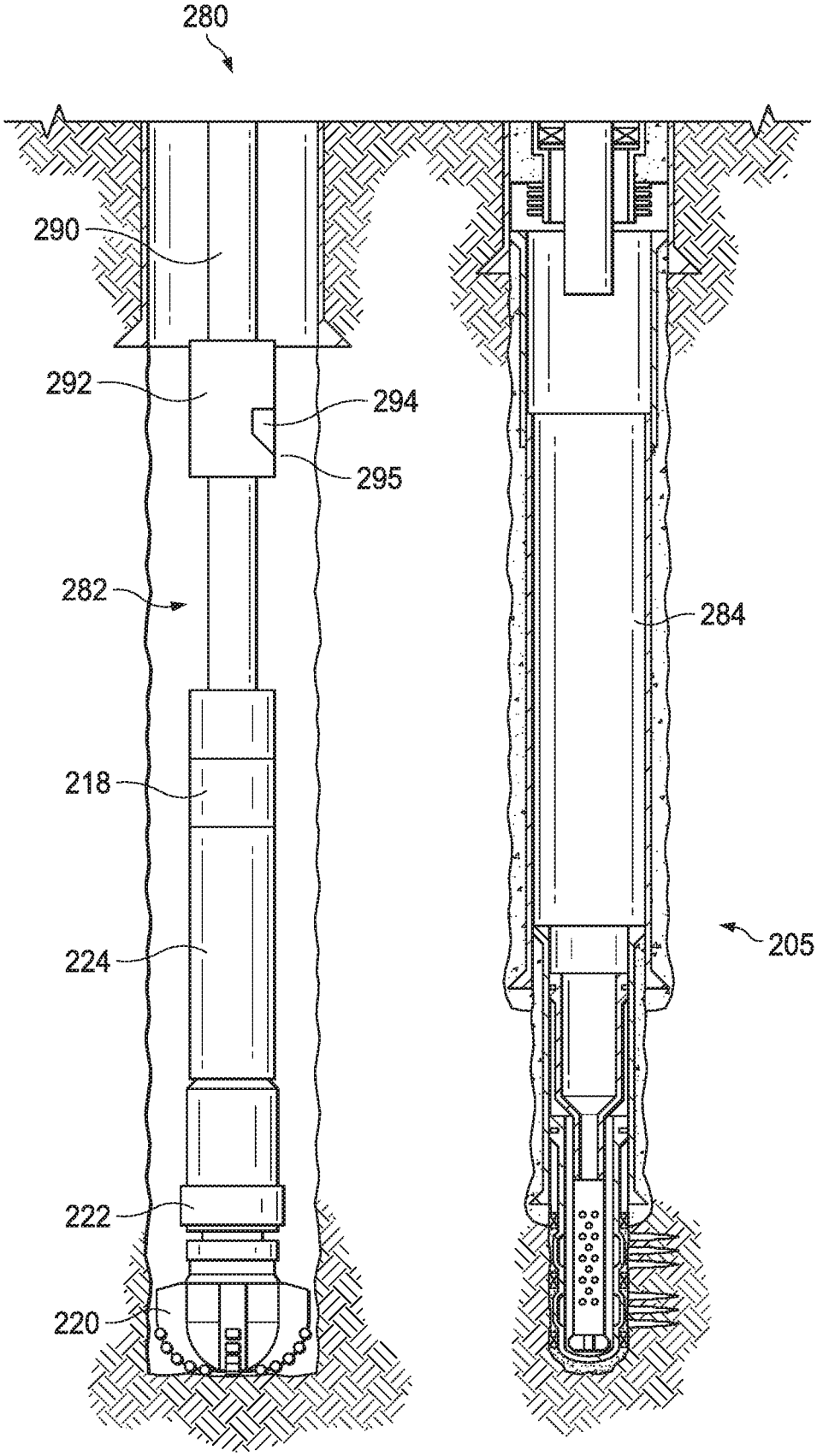
FIG. 2C is an illustration of a diagram of an example distributed electrode type energy through drill string.

FIG. 2C is an illustration of a diagram of an example distributed electrode type energy through drill string system 280. The powered drill string can transmit electrical current downhole and then transmit that electrical current to the subterranean formation effectively creating a distributed electrode. The current can then find the easiest path to the target well. Energy through drill string system 280 includes a drilling wellbore 282 and a target wellbore 284, within a subterranean formation 205. Inserted into drilling wellbore 282 is a powered drill string 290.

Powered drill string 290 is similar to drill string 210 with many similar components, except that power isolation sub 215 can be removed or positioned higher on the powered drill string 210. Powered drill string 290 can include a distributed electrode sub 292. Distributed electrode sub 292 can transmit the electrical current into subterranean formation 205 using transmission mechanism 294. The electrical transmission can be released at an outside location of the drill string at exterior location 295.

Figure 3:
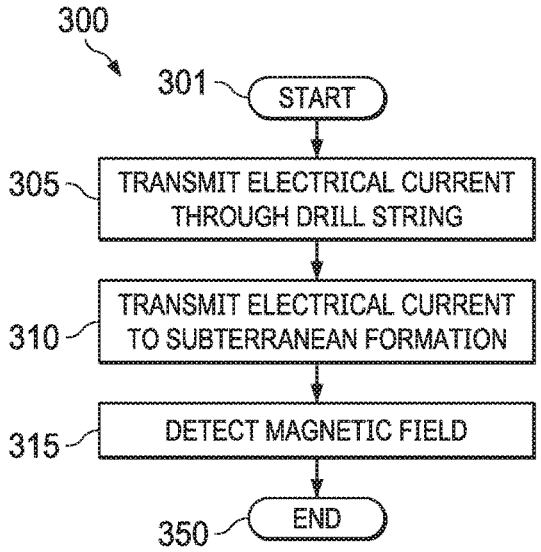
FIG. 3 is an illustration of a flow diagram of an example method to utilize a drill string to transmit electrical current to a downhole tool.

FIG. 3 is an illustration of a flow diagram of an example method 300 to utilize a drill string to transmit electrical current to a downhole tool. Method 300 starts at a step 301 and proceeds to a step 305. In step 305 electrical current can be transmitted through the drill string. The electrical current can be supplied by a surface electrical energy source. The electrical energy is typically AC, but DC electrical energy can be transmitted as well. Since active magnetic ranging equipment tends to utilize AC electrical energy, if DC electrical energy is transmitted, an energy converter step would need to be included.

Proceeding to a step 310, the downhole tool can utilize the received electrical current. The downhole tool can utilize the electrical current, such as to transmit the electrical current into the subterranean formation at a designated location. This can be accomplished using a power isolation sub using an electrical transmission device. The electrical transmission device can be adjustable and moveable to allow the electrical current to be released in a direction and angle determined by the well operators. In alternative aspect, the drill string itself can include a distributed electrode to transmit the electrical current into the subterranean formation. In another alternative aspect, the downhole tool can be an energy converter and the electrical current can be converted to a different energy form, such as mechanical, acoustic, and hydraulic.

Proceeding to a step 315, the magnetic field, generated by a portion of the subterranean formation or by collected electrical current on the target wellbore, can be detected by a downhole tool, such as an active magnetic ranging BHA. The detected magnetic field can be processed by the active magnetic ranging BHA or by other equipment proximate to the active magnetic ranging BHA. The processed data can be transmitted to surface well equipment for further analysis and action. In an alternative aspect, the detected magnetic field data can be transmitted to the surface well equipment with minimal additional processing. In another alternate aspect, when the electrical energy has been converted to another form, another downhole tool can utilize the converted energy to perform its prescribed functions. Method 300 ends at a step 350.

Figure 4:
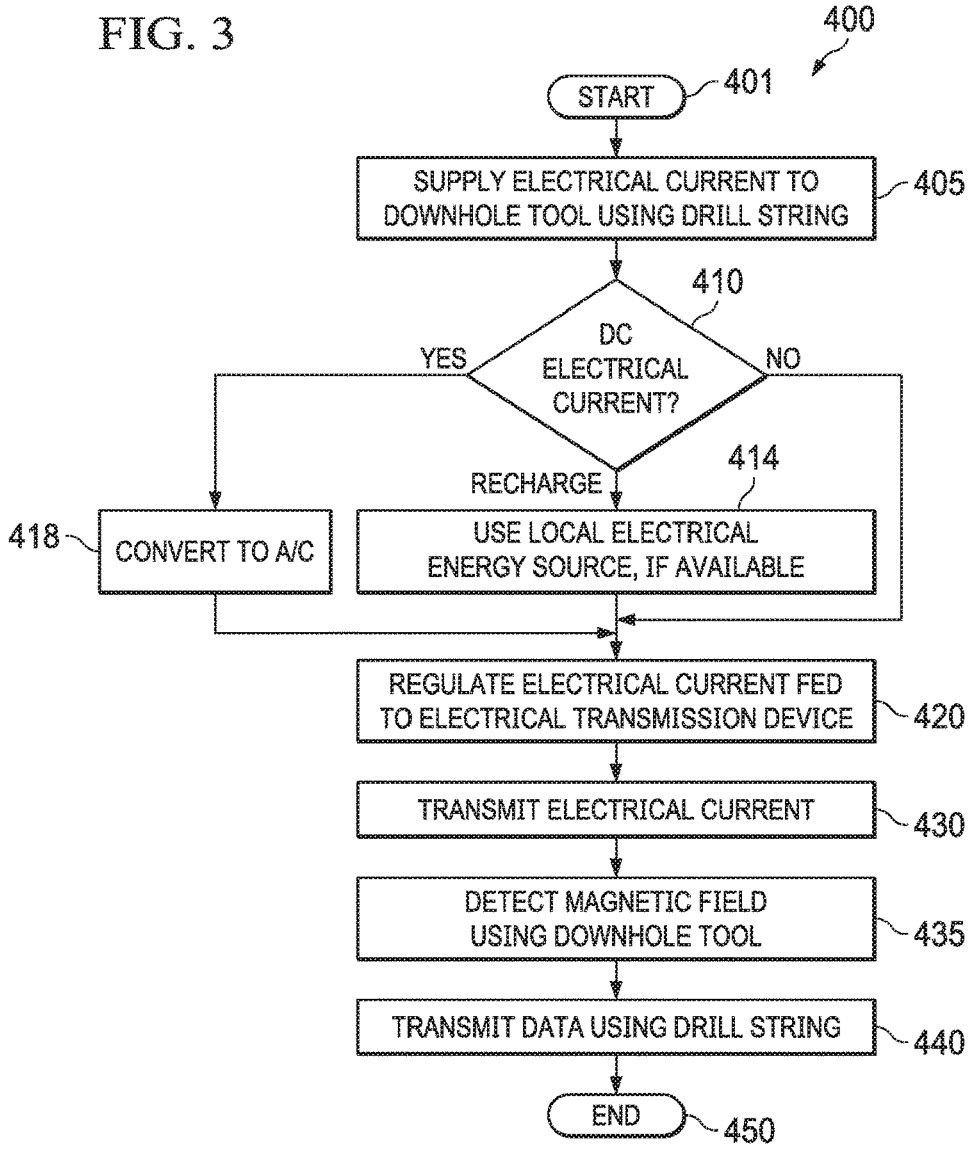
FIG. 4 is an illustration of a flow diagram of an example method to regulate electrical current from a drill string to a downhole tool.

FIG. 4 is an illustration of a flow diagram of an example method 400 to regulate electrical current from a drill string to a downhole tool. Method 400 builds on the functionality outlined in method 300. Method 400 starts at a step 401 and proceeds to a step 405. At step 405 electrical current is supplied by a surface energy source, transmitted through the drill string, to a downhole tool.

In a decision step 410, a determination is made utilizing the type of electrical current provided, either AC or DC. If DC is supplied, then method 400 proceeds to a step 418. In step 418, the DC is converted to AC by an energy converter and method 400 proceeds to a step 420. If AC is supplied, then method 400 proceeds to a step 420. In an optional step 414, regardless of the type of electrical current supplied, if a local electrical energy source is present, the supplied electrical current can be used to recharge the local electrical energy source, such as recharging batteries or capacitors. The local electrical energy source is shown as being recharged by the electrical current supplied through the drill string. In an alternative aspect, the local electrical energy source can be recharged from the electrical current supplied by the energy converter. After step 414 or step 418, method 400 proceeds to step 420.

In step 420, an optional energy regulator can regulate the electrical current provided to the downhole tool to allow a variable electrical current to be transmitted. For example, the variable amperage can be utilized to adjust the volume of interest measured by a downhole tool. The volume of interest can vary by adjusting the depth of the measurement volume, the width of the measurement volume, and the resolution, e.g., details, within the volume of measurement. For example, by adjusting the electrical current, the detectable distance at which the active magnetic ranging system can measure can be varied. In a step 430, a device, such as the power isolation sub, can transmit an electrical current into the subterranean formation. The electrical current can react with a portion of the subterranean formation, or collect at a target wellbore, and generate a magnetic field.

In a step 435, the active magnetic ranging BHA or another downhole tool, such as a magnetic gradient field sensor, can detect the magnetic field. In a step 440, the data collected during the detection can be transmitted to surface well equipment via the drill string. The transmission can be by a conventional means. Method 400 ends at a step 450.

Figure 5:
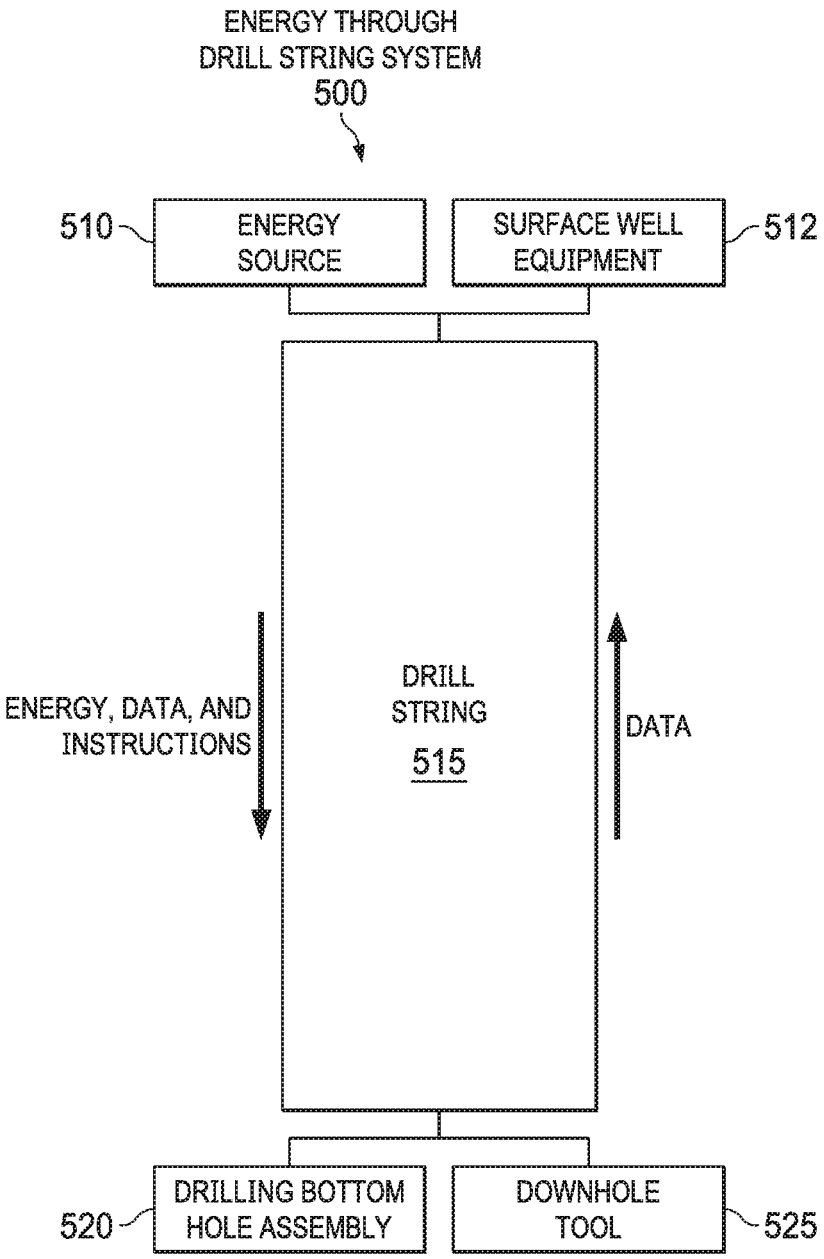
FIG. 5 is an illustration of a block diagram of an example energy through drill string system.

FIG. 5 is an illustration of a block diagram of an example energy through drill string system 500. Power through drill string system 500 includes an energy source 510 and surface well equipment 512. Energy source 510 can supply electrical current to the drill string 515. Energy source 510 can supply AC or DC electrical energy depending on the type of drill string 515 in use. Energy source 510 can be a conventional type of energy source, such as a generator. For example, a drill string using inductive coupling has to transmit DC electrical energy. The electrical current supplied by energy source 510 can be transmitted through drill string 515 to a drilling BHA 520 and a downhole tool 525, for example, an active magnetic ranging BHA.

Surface well equipment 512 can be dedicated equipment or a general computing device, for example, a server, a tablet, a smartphone, a laptop, a collection of servers, and one or more dedicated well system equipment components. Surface well equipment 512 can be one or more components. Surface well equipment 512 can be partially or fully located proximate to the wellbore and drill string 515 with the remaining portion of surface well equipment 512 located proximate to or a distance from the wellbore, such as in a cloud system or a data center.

Surface well equipment 512 can transmit data and instructions to one or more BHA, such as downhole tool 525 and drilling BHA 520. The transmission can be sent via drill string 515 and be by a conventional transmission method. For example, surface well equipment 512 can instruct downhole tool 525 to utilize a local electrical energy source, such as a capacitor. Downhole tool 525 can charge the capacitor using the electrical current received through drill string 515. Downhole tool 525 can then transmit electrical current to the subterranean formation at a higher electrical current than possible using the electrical current supplied directly from drill string 515.

Surface well equipment 512 can receive processed data and unprocessed data from downhole tool 525. The data can be transmitted using a conventional transmission method. Surface well equipment 512 can utilize the received data in further analysis leading to adjustments to the well operation plan, such as adjusting the drilling BHA parameters to more efficiently intercept a target wellbore.

Figure 6:
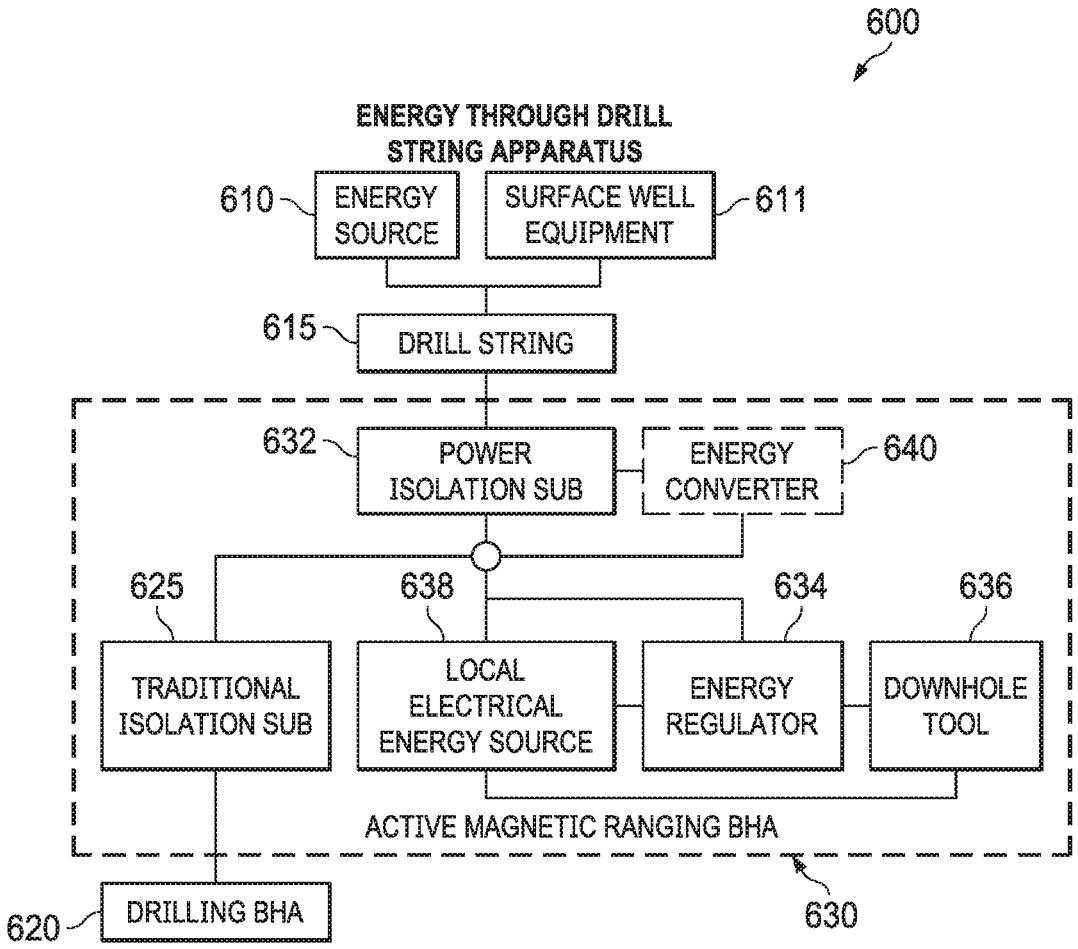
FIG. 6 is an illustration of a block diagram of an example energy through drill string apparatus.

FIG. 6 is an illustration of a block diagram of an example energy through drill string apparatus 600. Energy through drill string apparatus 600 includes an electrical energy source 610, a surface well equipment 611, a drill string 615, and an active magnetic ranging BHA 630. A drilling BHA 620 is shown for demonstration purposes and other tools can be used for energy through drill string apparatus 600. Electrical energy source 610 and at least part of surface well equipment 611 is located at or near the surface of the wellbore and proximate to drill string 615 so that they can be electrically coupled to drill string 615.

Electrical energy source 610 can supply electrical energy to active magnetic ranging BHA 630 by transmitting the electrical current through drill string 615. Surface well equipment 611 can communicate with active magnetic ranging BHA 630 by transmitting signals through drill string 615. Active magnetic ranging BHA 630 is electrically and physically coupled to drill string 615. Drill string 615 can be inserted into a wellbore where a drilling BHA 620 is attached at the bottom of drill string 615.

Active magnetic ranging BHA 630 includes a power isolation sub 632, an optional energy converter 640, a traditional isolation sub 625, an optional local electrical energy source 638, an energy regulator 634, and a downhole tool 636, such as an active magnetic ranging device. Optionally, additional downhole tools can be part of the apparatus, such as a magnetic gradient field sensor. These optional tools can assist in the detection and data processing of the resultant magnetic field data. Energy converter 640 can be included if the other devices in active magnetic ranging BHA 630 uses AC and DC is being supplied by electrical energy source 610.

Local electrical energy source 638 can be included as an optional component. It can be one or more batteries, capacitors, or other types of electrical storage devices. Local electrical energy source 638 can be recharged by the electrical current transmitted through drill string 615. Energy regulator 634 can adjust the electrical current allowed to pass to the electrical transmission device of active magnetic ranging BHA 630. This can be used to adjust the distance and angle efficiency of the magnetic field detection.

Power isolation sub 632 can provide electrical energy isolation along drill string 615, while permitting the pass through of a portion of the electrical current for use by other components of active magnetic ranging BHA 630 and other downhole tools. Power isolation sub 632 can also include an electrical transmission device to enable the transmitting of electrical current at a designated location within the wellbore and at a designated angle. This can increase the efficiency in detecting the resultant magnetic field in regards to relevant data for the intended ranging target. Traditional isolation sub 625 is used to provide electrical isolation between drill string 615 and drilling BHA 620.

Figure 7:
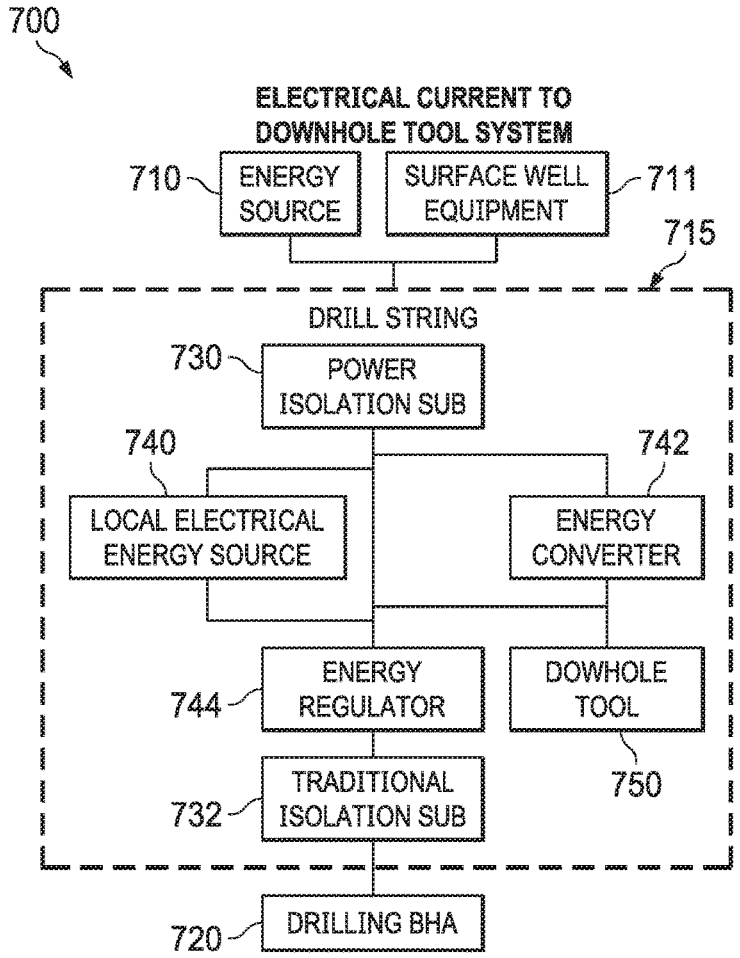
FIG. 7 is an illustration of a block diagram of an example electrical current to downhole tool system.

FIG. 7 is an illustration of a block diagram of an example electrical current to downhole tool system 700. Electrical current to downhole tool system 700 can be utilized to transmit electrical current from a surface energy source to a one or more downhole tools, including downhole tools designed to assist other downhole tools, such as energy regulators, energy controllers, and energy converters. Electrical current to downhole tool system 700 is similar to energy through drill string system 500 of FIG. 5 and energy through drill string apparatus 600 of FIG. 6 and has been generalized for various downhole tools.

Electrical current to downhole tool system 700 includes an energy source 710, a surface well equipment 711, a drill string 715, and a drilling BHA 720. Drill string 715 can have, as a part of, an attachment to, or co-located with, a power isolation sub 730, a traditional isolation sub 732, a local electrical energy source 740, an energy converter 742, an energy regulator 744, and a downhole tool 750.

Energy source 710 is located at or near a surface location, proximate surface well equipment 711. Energy source 710 can provide electrical current (AC or DC) to one or more of the components located downhole within the wellbore of the well system. The electrical current can be transmitted via drill string 715 and zero or more included electrical cables, drill string 715 can be used as an electrical return, or a combination thereof. Surface well equipment 711 can be one or more of various well site tools and equipment used to support the operations thereof, such as derrick 105, surface well equipment 108, or a combination thereof, of FIG. 1A or FIG. 1B. Drilling BHA 720 can be a conventional drilling bit and BHA.

Electrical current transmitted downhole can be passed to power isolation sub 730. Part or all of the electrical current can be passed through power isolation sub 730 to other downhole tools. Similar to power isolation sub 632, power isolation sub 730 can transmit electrical current into the subterranean formation to create an electrical buildup in the formation and thereby resulting in a magnetic field. Traditional isolation sub 732 can provide electrical isolation between drill string 715 and drilling BHA 720.

Local electrical energy source 740 can be one or more batteries, capacitors, or a combination thereof, and can be recharged using received electrical energy. The local electrical energy source 740 can be used to supply an amperage that is greater than that received downhole from energy source 710. In some aspects, energy source 710 can be combined with local electrical energy source 740 to provide a higher amperage to downhole tools than either energy source individually.

Energy regulator 744 can determine the source and combination of the electrical energy to provide to the other downhole tools, such as from energy source 710 and local electrical energy source 740. The volume of interest measured by downhole tool 750, such as an active magnetic ranging tool, can be altered or increased in size utilizing the combined energy sources. The volume of interest can be adjusted for depth (e.g., greater or lesser distance can be measured), for resolution (e.g., increased or decreased resolution within the volume of measurement), and angle of measurement (e.g., greater or lesser angle spread of measurement).

In some aspects, energy regulator 744 can analyze the available electrical current, that is available over a time interval, and compare that result to the well operation plan. Using the analysis, energy regulator 744 can act as an energy controller to parse the available energy into one or more energy sets using the number of execution cycles specified in the well operation plan. The energy set, e.g., an energy shot, can be transmitted to power isolation sub 730 (and subsequently transmitted to the subterranean formation) and downhole tool 750 (and subsequently used to collect measurement data) at the specified time points of the time interval. This process can create a pulse for downhole tool 750 to measure over the time interval.

In additional aspects, energy regulator 744 can vary the amperage of the energy shot, which can adjust the volume of interest. The measurement data collected as a result of an energy shot can be normalized using the amperage that was used for that energy shot. The normalization process can allow the data to be compared across multiple measurements collected from different energy shots.

Downhole tool 750 can be one or more of various downhole measurement tools, such as an active magnetic ranging tool (measuring a magnetic field intensity parameter), a formation tool (measuring a formation parameter), a drilling tool (measuring a drilling parameter), and a ranging tool (measuring a ranging parameter). In other aspects, downhole tool 750 can be one or more of an active resonance tool, a fluid flow diversion tool, a moveable BHA, a stabilizer pad, a bent housing for a mud motor or turbo drill, and other downhole tools.

Energy converter 742 is an optional component, to be used when one or more of energy source 710 and local electrical energy source 740 provides a type of electrical current that is different than what is used by downhole tool 750. For example, energy source 710 can transmit AC which is converted to DC by energy converter 742 when downhole tool 750 uses DC to operate. Energy converter 742 can transform the electrical current from one or more of the energy sources, or energy converter 742 can transform the output from energy regulator 744.

Figure 8:
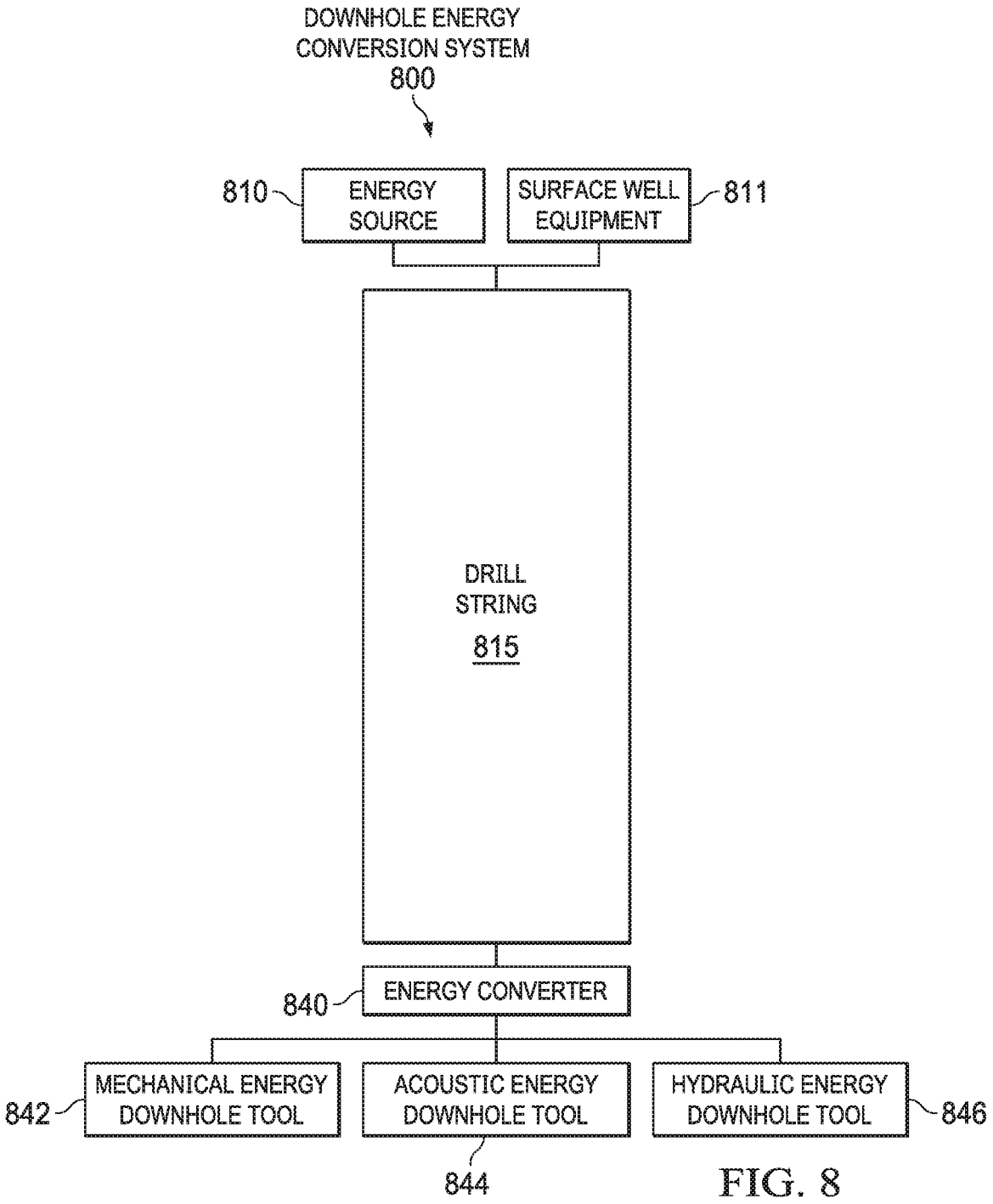
FIG. 8 is an illustration of a block diagram of an example downhole energy conversion system.

FIG. 8 is an illustration of a block diagram of an example downhole energy conversion system 800. Downhole energy conversion system 800 can be utilized to transmit electrical current downhole utilizing a drill string and then converting the electrical energy into another energy form for use by downhole tools. Downhole energy conversion system 800 includes an energy source 810, a surface well equipment 811, a drill string 815, an energy converter 840, and one or more downhole tools, such as mechanical energy downhole tool 842, acoustic energy downhole tool 844, and hydraulic energy downhole tool 846.

Similar to FIGS. 5, 6, and 7, energy source 810 is located at or near a surface location, proximate surface well equipment 811. Energy source 810 can provide electrical current to one or more of the components located downhole within the wellbore of the well system. The electrical current can be transmitted via drill string 815 and zero or more electrical cables, drill string 815 can be used as an electrical return, or a combination thereof. Surface well equipment 811 can be one or more of various well site tools and equipment used to support the operations thereof, such as derrick 105, surface well equipment 108, and a combination thereof, of FIG. 1A or FIG. 1B.

Energy converter 840 can be part of drill string 815, included with drill string 815, attached to drill string 815, or be a separate component from drill string 815. Energy converter 840 can convert the received electrical current into an alternate energy form, such as mechanical energy, acoustic energy, and hydraulic energy. The converted energy can be utilized by one or more downhole tools. Converted mechanical energy can be utilized by mechanical energy downhole tool 842, acoustic energy can be utilized by acoustic energy downhole tool 844, and hydraulic energy can be utilized by hydraulic energy downhole tool 846.

For example, the converted energy can be used to actuate a mechanism, such as open or closing a valve, diverting fluid flow, moving BHA members, such as stabilizer pads, in diameter and axial locations, changing a BHA configuration, such as a bend setting on an adjustable bent housing for a drive of a mud motor or a turbo drill, and altering the orientation of a bent housing to a specified tool face while off bottom or while on bottom drilling.

Figure 9C:
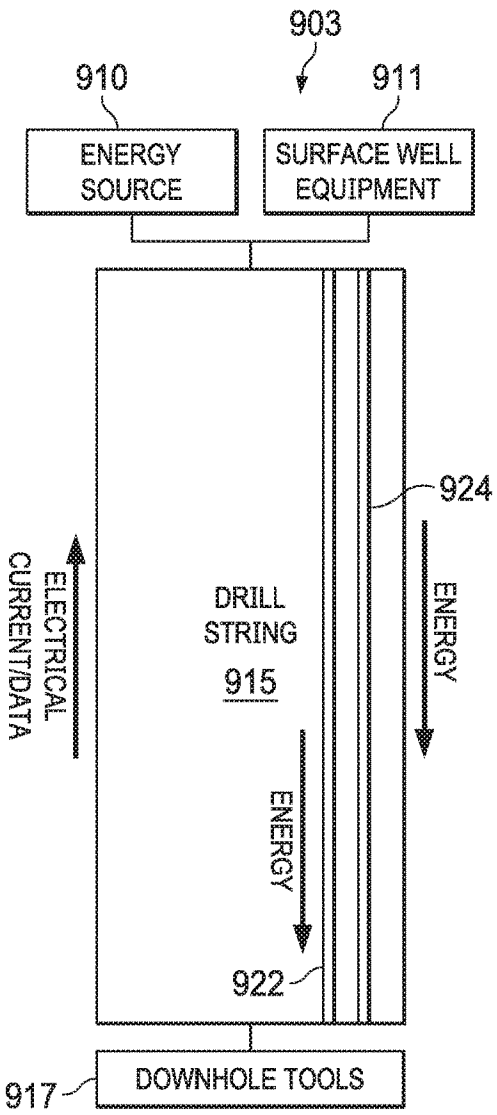
FIG. 9C is an illustration of a block diagram of an example drill string providing an electrical return system for downhole tools.
Figure 9B:
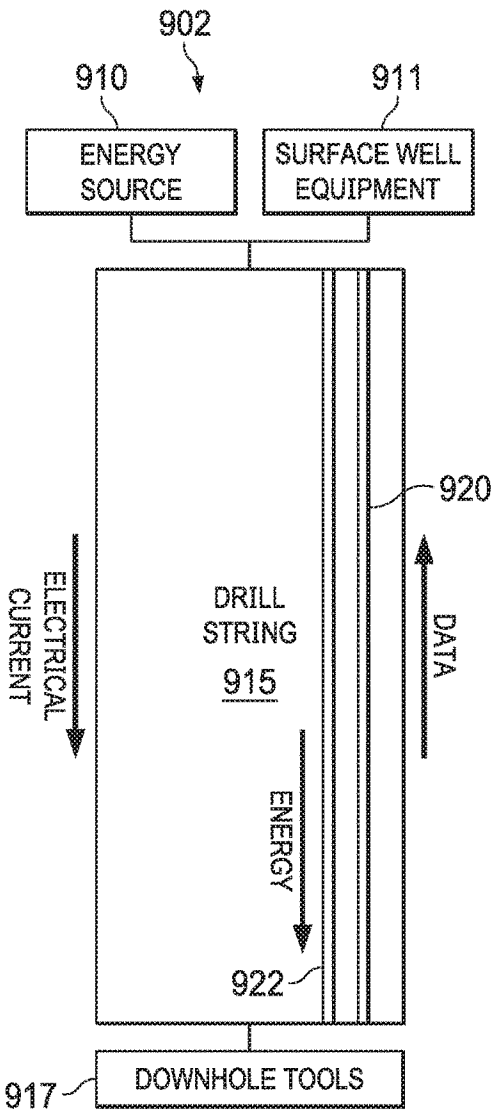
FIG. 9B is an illustration of a block diagram of an example drill string and electrical cable transmitting electrical current system.
Figure 9A:
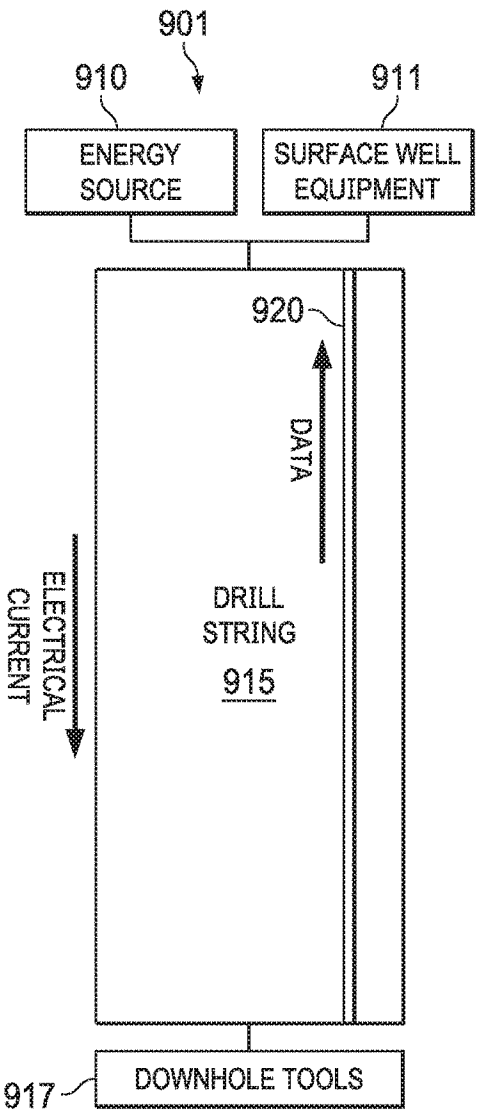
FIG. 9A is an illustration of a block diagram of an example drill string transmitting electrical current system.

FIGS. 9A, 9B, and 9C demonstrate alternative aspects of the disclosure where the drill string is utilized for electrical current distribution along with one or more electrical cables. The electrical cables can be part of the drill string, be contained within the drill string, or attached to the drill string. Each of these figures demonstrates an alternative aspect of electrical current transmission and data transmission. The data transmission can be data collected from downhole tools. Other combinations of electrical current transmission are possible, such as increasing the number of included electrical cables.

FIG. 9A is an illustration of a block diagram of an example drill string transmitting electrical current system 901, and includes energy source 910 located at or near a surface location, proximate surface well equipment 911. Surface well equipment 911 can be one or more of various well site tools and equipment used to support the operations thereof, such as derrick 105, surface well equipment 108, and a combination thereof, of FIG. 1A or FIG. 1B. Drill string 915 is electrically coupled to energy source 910 and mechanically coupled to surface well equipment 911. Downhole tools 917 can be one or more of the downhole components, such as power isolation sub 730, traditional isolation sub 732, local electrical energy source 740, energy converter 742, energy regulator 744, and downhole tool 750 as described in FIG. 7.

Drill string transmitting electrical current system 901 is demonstrating that drill string 915 can transmit electrical current from energy source 910 to downhole tools 917. An electrical cable 920 can be utilized as the electrical circuit return and, in addition, can carry a data transmission from downhole tools 917. Local electrical energy storage 740 can be utilized by downhole tools 917 to provide the electrical current to send the data transmission. Electrical cable 920 can be one of various conventional electrical cables.

FIG. 9B is an illustration of a block diagram of an example drill string and electrical cable transmitting electrical current system 902 and includes similar components as FIG. 9A. In this alternate aspect, there are two electrical cables, electrical cable 920 and electrical cable 922 present in the system.

Drill string and electrical cable transmitting electrical current system 902 is demonstrating that drill string 915 can transmit electrical current from energy source 910 to downhole tools 917. Electrical cable 920 can be utilized as the electrical circuit return and, in addition, can carry a data transmission from downhole tools 917. In addition, electrical cable 922 is present and can provide electrical current to downhole tools 917, such as to power downhole tools 917 and to charge local electrical energy source 740. Electrical cable 920 and electrical cable 922 can be various conventional electrical cables. In this aspect, the electrical current transmitted through drill string 915 can be utilized to transmit electrical current to the subterranean formation and electrical cable 922 can be used to provide electrical current to downhole measurement tools, such as an active magnetic ranging tool.

FIG. 9C is an illustration of a block diagram of an example drill string providing an electrical return system 903 for downhole tools and includes similar components as FIGS. 9A and 9B. In this alternate aspect, there are two electrical cables, electrical cable 922 and electrical cable 924 present in the system. In other aspects, more electrical cables can be present, for example, five electrical cables to provide electrical current to power isolation sub 730 and two electrical cables to provide electrical current to downhole tools 917.

Drill string providing an electrical return system 903 is demonstrating that drill string 915 can be an electrical return, completing an electrical circuit with downhole tools 917, in addition to providing a transmission path for transmitting data uphole to surface well equipment 911. Electrical cable 922 and electrical cable 924 can be utilized to transmit electrical current to downhole tools 917. The amperage of the electrical current transmitted by electrical cable 922 and electrical cable 924 can vary. Electrical cable 920 and electrical cable 922 can be various conventional electrical cables. In this aspect, the electrical current transmitted through electrical cable 922 can be utilized to transmit electrical current to the subterranean formation and electrical cable 924 can be used to provide electrical current to downhole measurement tools, such as an active magnetic ranging tool, and to charge local electrical energy source 740.

Figure 10:
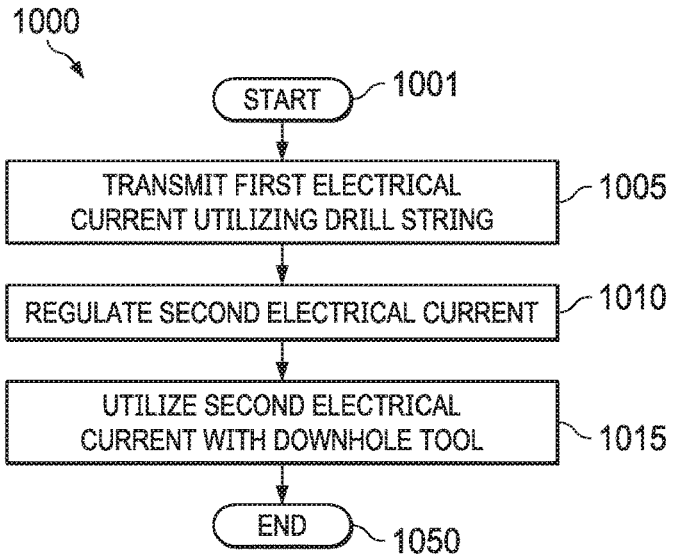
FIG. 10 is an illustration of a flow diagram of an example method to regulate electrical current at a higher amperage combining transmitted electrical current and a local electrical energy source.

FIG. 10 is an illustration of a flow diagram of an example method 1000 to regulate electrical current at a higher amperage combining transmitted electrical current and a local electrical energy source. Method 1000 can be utilized to transmit the combined electrical energy to a downhole tool. Method 1000 starts at a step 1001 and proceeds to a step 1005. In step 1005 a first electrical current can be transmitted utilizing the drill string, where the drill string has been inserted into a wellbore of a well system.

In a step 1010, a second electrical current, generated using the first electrical current combined with electrical current supplied by a local electrical energy source, can have an amperage that is greater than the first electrical current and the amperage supplied by the local electrical energy source. The combination of electrical currents can be controlled by an energy controller, such as an energy regulator. The combination ratio can be determined by analyzing the well operation plan and determining the amount of energy to be used at a specific time point.

In addition, the energy regulator can parse the available energy, i.e., combined electrical current, to generate energy sets, where the energy set is an energy shot transmitted to various downhole tools. The parsing can use a specified number of execution cycles. For example, if five execution cycles is specified in well operation plan, the available energy can be parsed such that each of the five energy shots can transmit roughly an equivalent amount of electrical current. Since the parsing analysis uses a time interval over which the energy shots are transmitted, the parsing analysis can account for additional electrical current being received over that time interval, e.g., the local electrical energy source can be recharging while the downhole tools are actively using the supplied electrical current.

In a step 1015, the second electrical current can be transmitted to one or more downhole tools, such as a power isolation sub and an active magnetic ranging tool, where the power isolation sub can transmit electrical current into the subterranean formation and the active magnetic ranging tool can measure the resulting magnetic field intensities. Method 1000 ends at a step 1050.

A portion of the above-described apparatus, systems or methods may be embodied in or performed by various digital data processors or computers, wherein the computers are programmed or store executable programs of sequences of software instructions to perform one or more of the steps of the methods. The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floptical disks; and hardware devices that are specially configured to store and execute program code, such as ROM and RAM devices. Examples of program code include machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

It is noted that as used herein and in the appended claims, the singular forms "a", "an", and "the" include plural referents unless the context clearly dictates otherwise.

Aspects disclosed herein include:

A. A method for transmitting electrical energy to a downhole tool including: (1) transmitting a first electrical current utilizing a drill string, wherein the drill string is located within a drilling wellbore of a well system, (2) regulating a second electrical current utilizing the first electrical current, wherein the regulating provides amperes that exceeds the amperes generated from the first electrical current, and (3) utilizing the second electrical current with the downhole tool.

B. A system to transmit electrical energy in a wellbore of a well system, including: (1) a downhole tool, operable to receive energy and perform an action within the wellbore, (2) a drill string, located in the wellbore and electrically coupled to a first energy source located at a surface position, operable to complete an electrical circuit, and (3) an energy regulator, located proximate the downhole tool and electrically coupled to the drill string, operable to regulate energy received and provide electrical current to the downhole tool.

Each of aspects A and B can have one or more of the following additional elements in combination: Element 1: wherein the regulating further comprises utilizing an energy regulator that sources electrical energy over an interval of time from a local electrical energy source. Element 2: further wherein the local electrical energy source has an amperage that is greater than an amperage of the first electrical current. Element 3: wherein the regulating further comprises analyzing an available energy, over a time interval, from an energy set including the first electrical current and the local electrical energy source. Element 4: wherein the regulating further comprises parsing the available energy into one or more energy shots using a specified number of execution cycles. Element 5: wherein the regulating further comprises transmitting each energy shot, at a specified time point within the time interval, as the second electrical current. Element 6: wherein an amperage for a first one of the energy shots is different than an amperage for a second one of the energy shots. Element 7: the downhole tool is an active magnetic ranging tool. Element 8: the measurements detected by the active magnetic ranging tool are normalized for the amperage of the first one of the energy shots and the amperage of the second one of the energy shots. Element 9: further comprising combining the second electrical current and the first electrical current to be utilized as a transmission energy source. Element 10: wherein the downhole tool is a measurement tool, and a volume of interest measured by the measurement tool is greater utilizing the second electrical current than utilizing the first electrical current. Element 11: wherein the measurement tool measures one or more of a ranging parameter, a formation parameter, a drilling parameter, or an active magnetic ranging parameter. Element 12: wherein the downhole tool is one of an active magnetic ranging tool, a valve, a fluid flow diversion tool, a moveable BHA, a stabilizer pad, or a bent housing. Element 13: further comprising transforming the second electrical current to a third electrical current utilizing an electrical converter. Element 14: further comprising converting the second electrical current to a converted energy comprising one or more of a mechanical energy, an acoustic energy, or a hydraulic energy, and the downhole tool utilizes the converted energy. Element 15: wherein the drill string includes an electrical cable to transmit the first electrical current, and the drill string transmits an electrical return from the downhole tool. Element 16: wherein the drill string includes more than one electrical cable, and a power isolation sub transmits electrical current from a first electrical cable to a location at a subterranean formation and a second electrical cable to the downhole tool utilizing an energy regulator. Element 17: further comprising charging a local electrical energy source utilizing the second electrical cable, and the regulating utilizes the first electrical cable and the local electrical energy source. Element 18: further comprising a local electrical energy source, operable to be charged by an electrical current received from the drill string. Element 19: wherein the energy regulator utilizes electrical current from the drill string and from the local electrical power source. Element 20: wherein the energy regulator is further operable to analyze available electrical current and generates one or more energy sets. Element 21: transmit each energy set as an energy shot, at a respective time interval, to the downhole tool. Element 22: further comprising a first electrical cable included with the drill string, operable to transmit electrical current to the energy regulator. Element 23: wherein the drill string provides a return path for the electrical current. Element 24: wherein the downhole tool is a measurement tool including one or more of an active magnet resonance tool, a formation measurement tool, a drilling tool, or a ranging tool. Element 25: further comprising a power isolation sub, operable to receive electrical current from the drill string and the energy regulator, and to pass electrical current through to the energy regulator and downhole tool.

What is claimed is:

1. A method for transmitting electrical energy to a downhole tool comprising:

transmitting a first electrical current utilizing a drill string, wherein the drill string is located within a drilling wellbore of a well system;

regulating a second electrical current utilizing the first electrical current, wherein the regulating provides amperes that exceeds the amperes generated from the first electrical current; and providing a transmission energy source by combining the second electrical current and the first electrical current.

2. The method as recited in claim 1, wherein the regulating further comprises utilizing an energy regulator that sources electrical energy over an interval of time from a local electrical energy source.

3. The method as recited in claim 2, further wherein the local electrical energy source has a local amperage that is greater than a first amperage of the first electrical current.

4. The method as recited in claim 3, wherein the regulating further comprises analyzing an available energy, over a time interval, from an energy set including the first electrical current and the local electrical energy source;

parsing the available energy into one or more energy shots using a specified number of execution cycles; and transmitting each of the one or more energy shots, at a specified time point within the time interval, as the second electrical current.

5. The method as recited in claim 4, wherein a first shot amperage for a first of the one or more energy shots is different than a second shot amperage for a second of the one or more energy shots, and the downhole tool is an active magnetic ranging tool and measurements detected by the active magnetic ranging tool are normalized for the first shot amperage and the second shot amperage.

6. The method as recited in claim 1, further comprising utilizing the second electrical current with the downhole tool.

7. The method as recited in claim 1, wherein the downhole tool is a measurement tool, and a volume of interest measured by the measurement tool is greater utilizing the transmission energy source than utilizing the first electrical current.

8. The method as recited in claim 7, wherein the measurement tool measures one or more of a ranging parameter, a formation parameter, a drilling parameter, or an active magnetic ranging parameter.

9. The method as recited in claim 1, wherein the downhole tool is one of an active magnetic ranging tool, a valve, a fluid flow diversion tool, a moveable BHA, a stabilizer pad, or a bent housing.

10. The method as recited in claim 1, further comprising transforming the second electrical current to a third electrical current utilizing an electrical converter.

11. The method as recited in claim 1, further comprising converting the second electrical current to a converted energy comprising one or more of a mechanical energy, an acoustic energy, or a hydraulic energy, and the downhole tool utilizes the converted energy.

12. The method as recited in claim 1, wherein the drill string includes an electrical cable to transmit the first electrical current, and the drill string transmits an electrical return from the downhole tool.

13. The method as recited in claim 12, wherein the drill string includes more than one electrical cable, and a power isolation sub transmits electrical current from a first electrical cable to a location at a subterranean formation and a second electrical cable to the downhole tool utilizing an energy regulator.

14. The method as recited in claim 13, further comprising charging a local electrical energy source utilizing the second electrical cable, and the regulating utilizes the first electrical cable and the local electrical energy source.

15. A system to transmit electrical energy in a wellbore of a well system, comprising:

a downhole tool, operable to receive electrical energy and perform an action within the wellbore;

a drill string, located in the wellbore and electrically coupled to a first energy source located at a surface position, operable to transmit a first electrical current and complete an electrical circuit; and an energy regulator, located proximate the downhole tool and electrically coupled to the drill string, operable to regulate electrical energy received from the first electrical current and a second electrical current from a local electrical energy source, provide electrical current to the downhole tool, and providing a transmission energy source by combining the first electrical current and the second electrical current.

16. The system as recited in claim 15, further comprising the local electrical energy source, which is operable to be charged by the first electrical current received from the drill string.

17. The system as recited in claim 16, wherein the energy regulator is further operable to analyze available electrical current and generate one or more energy sets, and transmit each of the one or more energy sets as an energy shot, at a respective time interval, to the downhole tool.

18. The system as recited in claim 15, further comprising a first electrical cable included with the drill string, operable to transmit the first electrical current to the energy regulator, and wherein the drill string provides a return path for the first electrical current.

19. The system as recited in claim 15, wherein the downhole tool is a measurement tool including one or more of an active magnet resonance tool, a formation measurement tool, a drilling tool, or a ranging tool.

20. The system as recited in claim 15, further comprising a power isolation sub, operable to receive the first electrical current from the drill string, and to pass electrical current through to the energy regulator and the downhole tool.

* * * * *